US005918607A

United States Patent [19]

Zucker

[11] Patent Number: 5,918,607

[45] Date of Patent: Jul. 6, 1999

[54] APPARATUS AND METHOD FOR HAIR TREATMENT

[75] Inventor: Shlomo Zucker, Michmoret, Israel

[73] Assignee: Wheel Technology Ltd., Kowloon, The Hong Kong Special Administrative Region of the People's Republic of China

[21] Appl. No.: 09/190,453

[22] Filed: Nov. 13, 1998

[51] Int. Cl.[6] ..... A45D 24/00

[52] U.S. Cl. ..... 132/200; 132/119.1

[58] Field of Search ..... 132/200, 119.1, 132/138, 129, 271

[56] References Cited

U.S. PATENT DOCUMENTS 3,850,181 11/1974 Baker ..... 132/119.1
3,870,056 3/1975 Stemme ..... 132/119.1
3,964,502 6/1976 Komatsu ..... 132/119.1
4,319,014 3/1982 Rowland ..... 132/119.1
5,343,881 9/1994 Golan et al. ..... 132/119.1

*Primary Examiner*—Todd E. Manahan
*Attorney, Agent, or Firm*—Mark M. Friedman

[57] ABSTRACT

An apparatus for treating hair comprises a motor, a housing engaging the housing, and a pair of combs, each comb movably engaged by the housing. A mechanism comprising two arms is engaged by the housing with each arm operably connected between one of the combs and the motor so as to force each comb to reciprocate substantially perpendicular to their longitudinal axis so as to cause the teeth of each comb to reciprocally cross back-and-forth, over and between the teeth of the other comb member. The apparatus can be used for detangling hair, removing parasites such as lice, and/or removing particles such as dandruff.

17 Claims, 4 Drawing Sheets

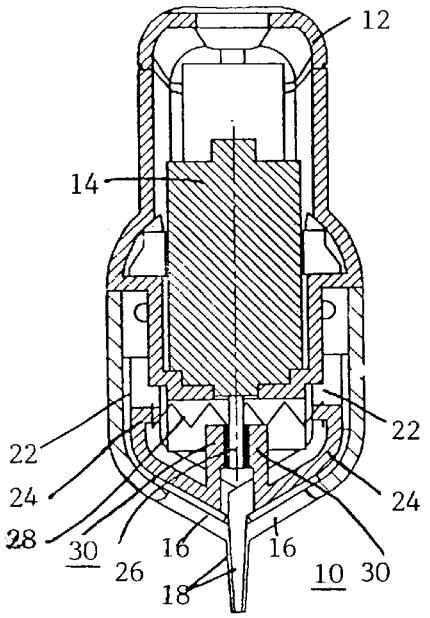
Fig. 1
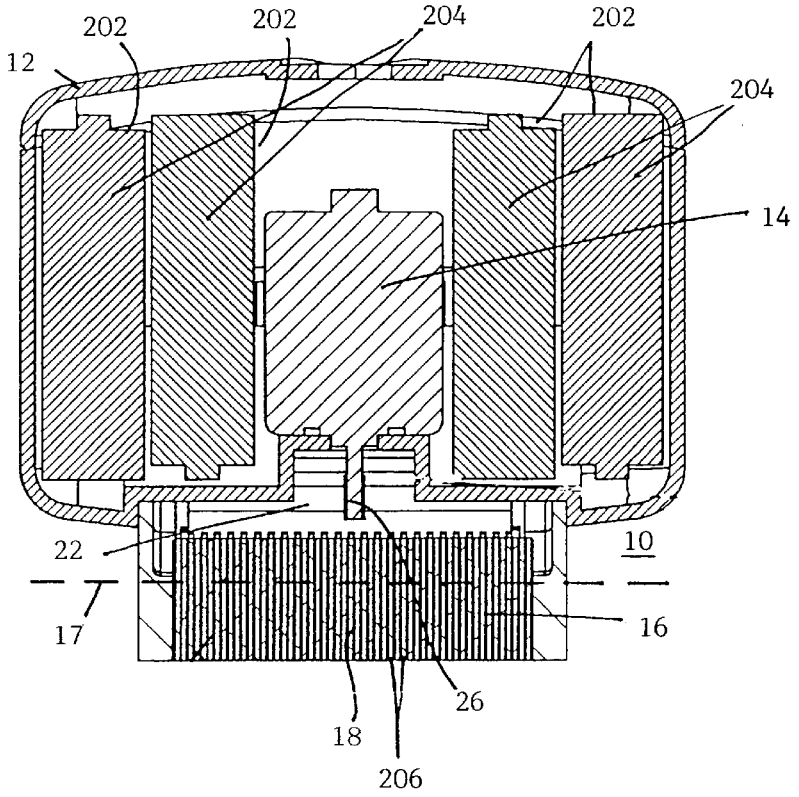
Fig. 2
Fig. 3
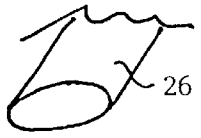

APPARATUS AND METHOD FOR HAIR TREATMENT

FIELD AND BACKGROUND OF THE INVENTION

The present invention relates, in general to apparatus and method for treatment of the hair. More particularly, the present invention relates to apparatus and method effective in detangling hair, inactivating parasites, such as lice present in the hair, and removing particles, such as dandruff, therefrom.

Many different types of powered devices are available for combing the hair, whether for grooming purposes or for purposes of treating hair and/or scalp conditions, such as removal of lice and dandruff.

U.S. Pat. No. 3,474,795 to Hantman et al. discloses a hair dressing device having an electric motor and drive mechanism releasably connected to a comb for rapidly oscillating the comb. The comb defines a relatively wide, elongate portion and a plurality of teeth extending transversely from the elongate portion. The comb is arranged so as to be oscillated by the drive mechanism about an axis extending parallel to the elongate portion and also extending through the junction points of the teeth and the elongate portion, or through the teeth at a location somewhat spaced from the junction points. As the comb is oscillated, no force is imparted to hairs it may be sought to separate along the axis, portions of the comb lying along the axis thus defining "dead points", at which no work is done by the comb teeth. At a distance from the axis a force is, however, delivered by the teeth in proportion to the distance from the axis.

It will thus be appreciated that the device to Hantman et al. is inefficient, as at least a portion of each tooth serves no useful purpose in freeing knots and tangles in the hair it engages.

Furthermore, the amplitude of oscillation of the teeth and thus the force delivered thereby is directly proportional to their perpendicular distance from the axis. Thus, in order to obtain even a relatively small amplitude of oscillation at a point on each tooth element relatively close to the axis, the amplitude of oscillation of the points furthest from the axis and thus the force delivered thereat is unacceptably large. Although no preferred amplitude, per se, is specified, the oscillation of the tooth ends is specified as being typically in the range 20° to 40°, while " . . . useful results may generally be obtained in the range 5° to 150° . . . ". It will be appreciated that as the degree of discomfort experienced by a user is dependent, inter alia, on the amplitude (in terms of the distance covered by a tooth end in a single oscillation), and not specifically on the arc through which the comb is oscillated, no preferred amplitude is, in fact, specified by Hantman et al.

U.S. Pat. Nos. 3,850,181 and 3,840,030 to Baker and 3,850,180 to Ryckman Jr. et al., disclose hair detangling devices, each has a pair of fixed combs spaced about an axis, and a movable comb which is aligned along the axis and is reciprocated therealong so as to detangle hair with which the combs are engaged. The teeth of the combs extend perpendicular to the axis and, in order to permit access of the movable member to the scalp, the teeth of the movable member are longer, and thus protrude beyond the teeth of the fixed combs so as to directly contact the scalp.

U.S. Pat. No. 3,384,096 to Paccione teaches an oscillatory teasing comb comprising a housing having an annular portion at one end and a flat and open longitudinal portion extending for substantially the length of a comb and terminating in a raised portion. Means are provided for pivotally mounting the frame in the housing, on the inner face thereof, in order to permit an oscillating movement of the frame in the housing. A drive shaft is rotatably mounted relative to the housing having eccentric means on the drive shaft, and means for automatically selectively oscillating the drive shaft are provided, as well as a plate for operatively connecting the drive shaft with the frame for oscillating movement of the latter, and a teasing comb removably secured in the frame and joining the oscillating movement of the latter. The teasing comb has a plurality of teeth spaced from an axis and operative to be oscillated thereabout. The spacing of each tooth from the axis is relatively small, however, being approximately one-tenth of the length of a tooth, and does not provide a satisfactory solution to the "dead point" described above in connection with the device of Hantman et al. Furthermore, Paccione does not disclose a preferred amplitude to oscillation of the comb about the axis.

U.S. Pat. No. 3,461,883 to Maris describes a handle, a comb and motive means. In one embodiment, the comb is positioned at right angles to the motive means, and is associated therewith via a transmission, the resultant motion being a combination of a linear motion, perpendicular to the comb, and a parallel, circular motion of the comb.

U.S. Pat. Nos. 3,853,133 and 3,964,502 to Komatsu et al. describe similar devices, each having a handle, a housing attached to the handle, and apparatus, associated with the housing, for counter-reciprocating a pair of parallel hair combs along its longitudinal axis.

German Patent No. 36 04 009 is directed to a power driven hair combing device. The device includes a handle, a comb and a drive for oscillating the comb in a back-and-forth motion along its longitudinal axis.

French Patent No. 1,263,225 to Peyron discloses a device for cleaning a head or hair. The device comprises an oscillating disc having a set of teeth (oscillating teeth) protruding at right angles therefrom, and a planar, circular, sponge-like member through which the teeth extend so as no protrude therebeyond. As cleaning of hair requires contact thereof with the sponge-like member, the oscillating teeth protrude beyond the sponge-like member by a short distance, typically about 3–4 mm. The oscillating disk is mounted onto a housing for oscillation about an axis extending perpendicular to the disk. Operation of the device in association with a head of hair causes removal of dirt therefrom. Two diametrically positioned, mutually perpendicular lines of fixed teeth, attached to the housing and extending through suitable openings in the oscillating disk and in the sponge-like member, extend parallel to and beyond the oscillating teeth. The fixed teeth are intended to support the device on the scalp, and thereby prevent contact between the oscillating teeth and the scalp. As the oscillatory motion is about an axis that is perpendicular to the disk and parallel to the teeth, the oscillating teeth nearest the oscillation axis experience very little movement, while the oscillating teeth furthest from the oscillation axis experience a relatively large movement. The fixed and oscillating teeth of the described device are configured for entry into a head of hair, until further entry into the hair is prevented, depending on the thickness of the hair, either by engagement of the fixed teeth with the scalp, or by engagement of the hair by the sponge-like member. As the disk and sponge-like member are rotated, adjacent hairs and dirt cling to the sponge-like member. Although such motion is useful when seeking to remove dirt, it actually hinders hair separation, being contrary to the type of motion required for the separation of hairs. The device described includes fixed teeth. While these fixed teeth extend beyond the oscillating teeth in a direction parallel thereto, they do not provide an efficient means of protection of the scalp from the oscillating teeth. This is mainly due to the circular arrangement of the oscillating teeth, and to the provision of the fixed teeth in two mutually perpendicular lines. In particular, in order to prevent the scalp from being struck by the oscillating teeth, they need to be diametrically aligned with a line of fixed teeth. If they are not aligned, given that the scalp is a rounded surface, tilting the device, even at a small angle, will bring the oscillating teeth into engagement with the scalp. The majority of oscillating teeth are never diametrically aligned with a line of teeth, and even those teeth that, when the device is at rest, are aligned with the fixed teeth, move into and out of alignment therewith when they are oscillated. Accordingly, the fixed teeth provide very limited protection to the scalp. If a mass of hair engaged by the hair cleaning device is of more than a predetermined thickness, such that the protrusion of the fixed teeth beyond the oscillating tooth is not sufficient so as to penetrate through to the scalp, the oscillating sponge-like member and the oscillating teeth become engaged in the mass of hair. The mass of hair is thus operative to conduct the oscillatory motion of the sponge-like member and the oscillating teeth directly to the hair and from there, to the scalp. The result is thus somewhat like a scalp massage, this being described in the cited document as being a beneficial result produced by use of the device. Accordingly, even if the hair cleaning device is used in such a manner that the oscillating teeth do not strike the scalp, the fixed teeth nonetheless provide only limited protection to the scalp.

The following references describe various additional electrically powered hair treatment devices. U.S. Pat. No. 2,479,253 describes a device having handle, one or two combing or massaging elements attached to the handle, and a motor for vibrating the one or two combing or massaging element longitudinally. U.S. Pat. No. 3,204,469, describes a teasing comb having a handle, an elongate comb attached via an end thereof to the handle, and motive means. The motive means is operative to rotate the comb through an elliptical or circular path relative to an axis. U.S. Pat. No. 3,272,023 describes apparatus having a handle, a pair of parallel comb members, and apparatus for driving the comb members in counter reciprocating fashion. U.S. Pat. No. 3,421,522 describes a device having a handle, a hair teasing element, and means for reciprocally oscillating the hair teasing element about an axis extending therethrough. U.S. Pat. No. 3,701,354 describes a device having a handle, a teasing comb, and motive means for reciprocating the teasing comb along its longitudinal axis, relative to the handle. U.S. Pat. No. 3,782,395 describes an electrically operated hair teasing device having a handle, a teasing comb, and motive means for producing a side-to-side rocking motion of the teasing comb relative to the handle. U.S. Pat. No. 3,870,056 describes an electrical hair detangling device employing a pair of counter-reciprocating combs or brushes. U.S. Pat. No. 4,139,014 describes a styling comb/styling implement having a handle, a motor, a heat source, and a pair of counter-reciprocating combs.

The following references are also noted as teaching hair treatment apparatus: U.S. Pat. Nos. 2,206,365; 3,252,175; 3,349,782; 3,358,309; 3,427,674; 3,750,680; 3,863,652; 3,894,547; 3,894,549; 3,897,794; 4,376,441; 4,532,707; 4,729,147 and German Patent No. 22 09 831.

There are available a number of different types of treatment for the removal of parasites, such as lice, that live in human hair. Among these treatments are chemical treatments such as special types of shampoo and mechanical treatments provided by purpose-made combs. These are often used in combination.

Combing the hair as a means of killing and/or removing lice from the hair is discussed in an article by K. A. Saunders, BPharm, MPS, entitled "Treatment of Head Lice", published in The Pharmaceutical Journal, issue date Sep. 22, 1984. In the article, it is stated that the head louse cannot recover from injury, loss of a leg being fatal injury to the head louse. The author further recommends that regular thorough grooming of the hair with a comb is, therefore, the best way to prevent infestation with head lice.

A similar statement is made in an article by J. W. Maunder, M. Sc., B. Sc., entitled "Parasites and Man, Human Lice—Biology and Control", published in the Journal of the Royal Society of Health in 1977.

U.S. Pat. No. 3,794,050 to Gallanis teaches an apparatus for detangling hair including a pair of closely spaced comb members which are reciprocated in an out of phase relationship to create wave motion in hair for the purpose of detangling it. The combs are detachably mounted with respect to the reciprocating mechanism and are simple, molded plastic elements having guiding and supporting portions which detachably secure to the reciprocating mechanism. The teeth of the combs being thickened to prevent oscillation or vibration and to permit the delivery of substantial amounts of power in moving or flexing the locks of hair by the reciprocating mechanism.

U.S. Pat. No. 5,343,881 to Golan teaches apparatus for treating hair including a handle; hair separation apparatus having a generally elongate base portion associated with the handle, and a plurality of parallel teeth attached to the base apparatus, and extending transversely therefrom, each tooth having a free end; and drive apparatus for oscillating the plurality of teeth at a frequency of no less than about 3,000 cycles per minute and for limiting a stroke of the free end of each the tooth to a length of no greater than approximately 8 mm, and for bringing the plurality of teeth into repeated engagement with a group of hairs attached to skin, thereby to ease passage of the hair separation apparatus through the group of hairs at a level of discomfort tolerable to a user.

U.S. Pat. No. 4,612,944 to Bachrach et al. and U.S. Pat. No. 4,612,945 to Bachrach teach a comb for removing lice and nits from the hair. The comb comprises a base and a plurality of teeth extending from the base in substantially the same direction. The longitudinal axes of the tooth are parallel to each other. Each tooth has a polygonal cross section shape, this being a diamond shape in the patent to Bachrach et al. and a triangle shape in the patent to Bachrach. The cross-sectional dimensions of each tooth enlarge from the free end thereof toward the base so that the spacing between adjacent teeth narrows toward the base. The facing edges of adjacent teeth interact with each other to capture, in a scissors-like manner, lice and nits therebetween.

Among disadvantages of the recommended conventional combing and use of the comb to Bachrach et al. and to Bachrach, is that individual hairs tend to become tightly knotted together or stuck together and thorough combing of the hair may, therefore, be extremely painful and, consequently, difficult to carry out efficiently.

However, the prior art fails to teach a hair treatment apparatus having two comb members designed to reciprocate substantially perpendicularly to its longitudinal axis, so as to cause the teeth thereof to reciprocally cross back and forth over and between, so as to detangle hair, inactivate parasites, such as lice present in the hair and remove particles such as dandruff therefrom. It will be appreciated that such a configuration and mechanism of action is not only novel, but it is also superior as is compared with all of the above described mechanisms.

SUMMARY OF THE INVENTION

It is one object of the present invention to provide apparatus and method effective hair treatment, in particular, in detangling hair, and in inactivating/removing parasites, such as lice and/or particles, such as dandruff thereof.

It is another object of the present invention to effect hair treatment as described by reciprocating two comb members substantially perpendicularly to its longitudinal axis, so as to cause the teeth of each of the two comb members to reciprocally cross back and forth over and between the teeth of the other comb member.

Thus, according to one aspect of the present invention there is provided an apparatus for treatment of hair comprising (a) a housing engaging a motor; (b) two comb members each having a longitudinal axis and being formed with teeth, each of the two comb members is movably engaged by the housing; and (c) a mechanism being engaged by the housing and operatively connecting between each of the two comb members and the motor, so as to force each of the two comb members to reciprocate substantially perpendicularly to its longitudinal axis, so as to cause the teeth of each of the two comb members to reciprocally cross back and forth over and between the teeth of the other comb member.

According to another aspect of the present invention there is provided a method of treatment of hair comprising the steps of (a) providing two comb members each having a longitudinal axis and being formed with teeth; (b) contacting in a combing action the two comb members with the hair to be treated; and (c) while combing the hair, reciprocating each of the two comb members substantially perpendicularly to its longitudinal axis, so as to cause the teeth of each of the two comb members to reciprocally cross back and forth over and between the teeth of the other comb member.

According to further features in preferred embodiments of the invention described below, the mechanism includes two arms each engaging one of the two comb members, each of the arms is reciprocated by an eccentric shaft rotated by the motor.

According to still further features in the described preferred embodiments the mechanism includes two arms each engaging one of the two comb members, each of the arms is reciprocated by an elliptic shaft rotated by the motor and which serves for departing the two comb members and further by a returning spring element which serves for attracting the two comb members.

According to still further features in the described preferred embodiments the housing is formed with at least one battery accepting slot for accepting at least one battery, the at least one battery serves for providing the motor with power for operation.

According to still further features in the described preferred embodiments each of the comb members reciprocates about 3,000 to about 12,000 times per minute.

According to still further features in the described preferred embodiments when maximally crossed over, the teeth of the two comb members form an angle of about 0° to about 5° therebetween.

According to still further features in the described preferred embodiments each of the teeth narrows towards an end thereof farther from a base portion of its respective comb member.

According to still further features in the described preferred embodiments a gap of about 0.05 mm to about 0.5 mm is present between adjacent teeth.

According to still further features in the described preferred embodiments each of the teeth extends about 8 mm to about 26 mm from a base portion of its respective comb member.

The present invention successfully addresses the shortcomings of the presently known configurations by providing apparatus and method effective in detangling hair, and in inactivating/removing parasites, such as lice and/or particles, such as dandruff thereof.

BRIEF DESCRIPTION OF THE DRAWINGS

The invention herein described, by way of example only, with reference to the accompanying drawings, wherein:

FIG. 1 is a cross sectional view of an apparatus for hair treatment according to one embodiment of the present invention, featuring an elliptic shaft for generating reciprocal movement;

FIG. 2 is another cross sectional view of the apparatus for hair treatment shown in FIG. 1;

FIG. 3 is a perspective view of an elliptic shaft used for generating a reciprocal movement in the apparatus of FIGS. 1 and 2;

DESCRIPTION OF THE PREFERRED EMBODIMENTS

Figure 4:
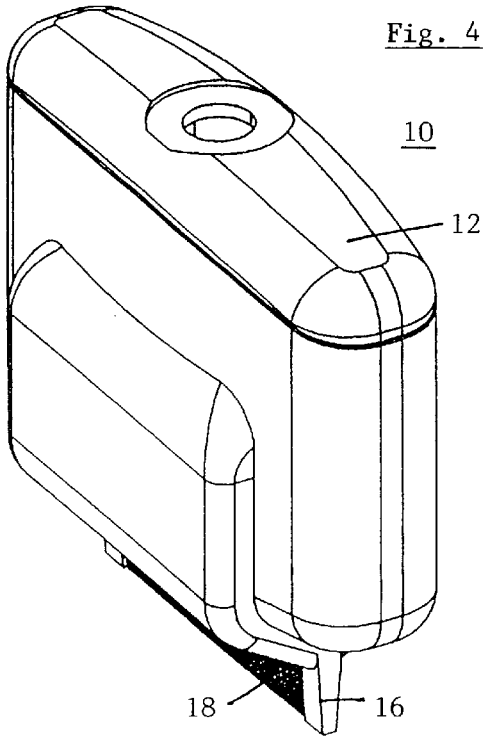
FIG. 4 is a perspective view of the apparatus shown in FIGS. 1 and 2.
Figure 5:
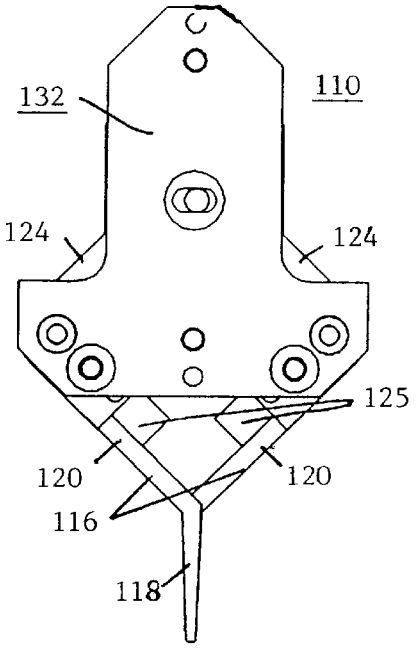
FIGS. 5 and 6 are end views of an apparatus for hair treatment according to another embodiment of the present invention, featuring an eccentric shaft for generating reciprocal movement.
Figure 6:
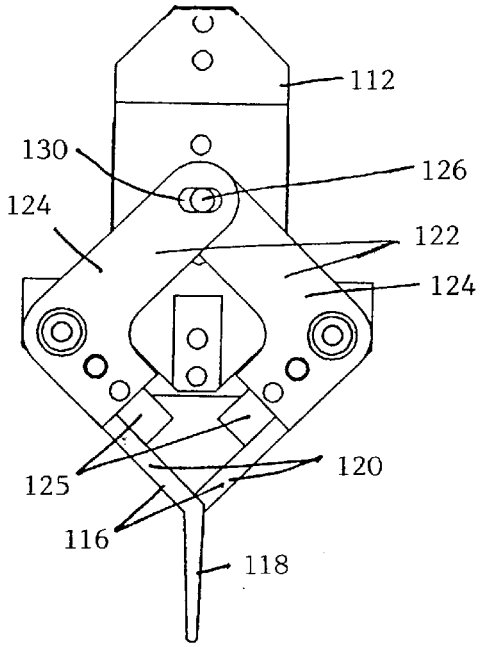
Figure 7:
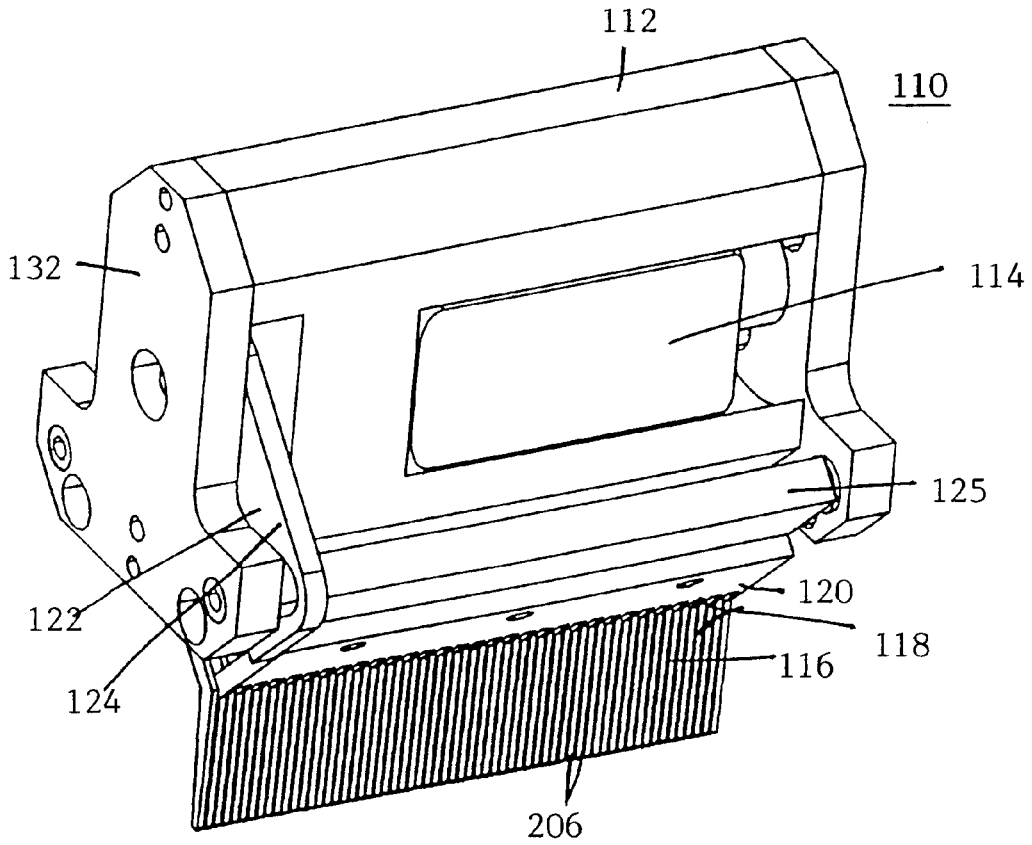
FIG. 7 is a perspective view of the apparatus shown in FIGS. 5 and 6.

The present invention is of apparatus and method which can be used for treating hair. Specifically, the present invention can be used for detangling hair, and inactivating/removing parasites, such as lice and/or particles, such as dandruff thereof.

The principles and operation of an apparatus and method according to the present invention may be better understood with reference to the drawings and accompanying descriptions.

Before explaining at least one embodiment of the invention in detail, it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting.

Referring now to the drawings, FIGS. 1–4 illustrate a hair treatment apparatus according to one embodiment of the present invention, which is referred to hereinbelow as apparatus 10.

Apparatus 10 includes a housing 12 (seen perceptively in FIG. 4). Housing 12 serves for engaging a motor 14, preferably an electrically operated motor producing a rotational movement, as further detailed hereinunder.

Apparatus 10 further includes two comb members 16. Each of comb members 16 features a longitudinal axis 17 (shown in FIG. 2) and is formed with teeth 18, which are set connected to, or integrally formed with, a base portion 20 of each of comb members 16. As further detailed hereinunder, each of two comb members 16 is directly or indirectly movably engaged by housing 12.

Apparatus 10 further includes a mechanism 22 which is engaged by housing 12. Mechanism 22 serve for operatively connecting between each of two comb members 16 and motor 14, so as to force each of two comb members 16 to reciprocate substantially perpendicularly to its longitudinal axis 17, so as to cause teeth 18 of each of two comb members 16 to reciprocally cross back and forth over and between teeth 18 of the other comb member 16.

According to this embodiment of the present invention, mechanism 22 includes two arms 24 (best seen in FIG. 1), each engaging directly or indirectly (via a connecting piece) one of two comb members 16. Each of arms 24 is rotatably engaged by housing 12 and reciprocated by an elliptic shaft 26 (shown enlarged in FIG. 3), itself rotated by motor 14 and which serves for departing two comb members 16 one from the other. To this end, each of arms 24 features an extension 30 which proximates shaft 26, such that when shaft 26 rotates, extensions 30 as well as arms 24 and comb member 16 connected thereto depart to the greatest extent when the longer axis of the shaft's cross section is set perpendicularly to extensions 30. When, on the other hand, the shorter axis of the shaft's cross section is set perpendicularly to extensions 30, then a returning spring element 28, which forms an additional part of mechanism 22, and is connecting between arms 26, serves for attracting two comb members 16 towards and across one another. Thus, the rotation of elliptic shaft 26 forces comb members 16 away from one another in a reciprocal fashion, while returning spring element 28 forces them back.

FIGS. 5–8 illustrate a hair treatment apparatus according to another embodiment of the present invention, which is referred to hereinbelow as apparatus 110.

Apparatus 110 includes a housing 112. Housing 112 serves for engaging a motor 114, preferably an electrically operated motor producing a rotational movement, as further detailed hereinunder.

Apparatus 110 further includes two comb members 116. Each of comb members 116 features a longitudinal axis 117 (shown in FIG. 8) and is formed with teeth 118, which are set connected to, or integrally formed with, a base portion 120 of each of comb members 116. As further detailed hereinunder, each of two comb members 116 is directly or indirectly movably engaged by housing 112.

Apparatus 110 further includes a mechanism 122 which is movably engaged by housing 112. Mechanism 122 serve for operatively connecting between each of two comb members 116 and motor 114, so as to force each of two comb members 116 to reciprocate substantially perpendicularly to its longitudinal axis 117, so as to cause teeth 118 of each of two comb members 116 to reciprocally cross back and forth over and between teeth 118 of the other comb member 16.

According to this embodiment of the present invention, mechanism 122 includes two arms 124, each engaging directly or indirectly (via a connecting piece 125, itself rotatably engaged by housing 112) one of two comb members 116. Each of arms 124 is reciprocated by an eccentric shaft 126 (best seen in FIG. 8) rotated by motor 114 and which serves for reciprocally departing and attracting two comb members 116 one from and to the other. To this end, each of arms 124 features an elongated accepting opening 130 for engaging shaft 126, such that an appropriate reciprocating linear movement is imposed on arms 124 when shaft 126 accentrically rotates.

Figure 8:
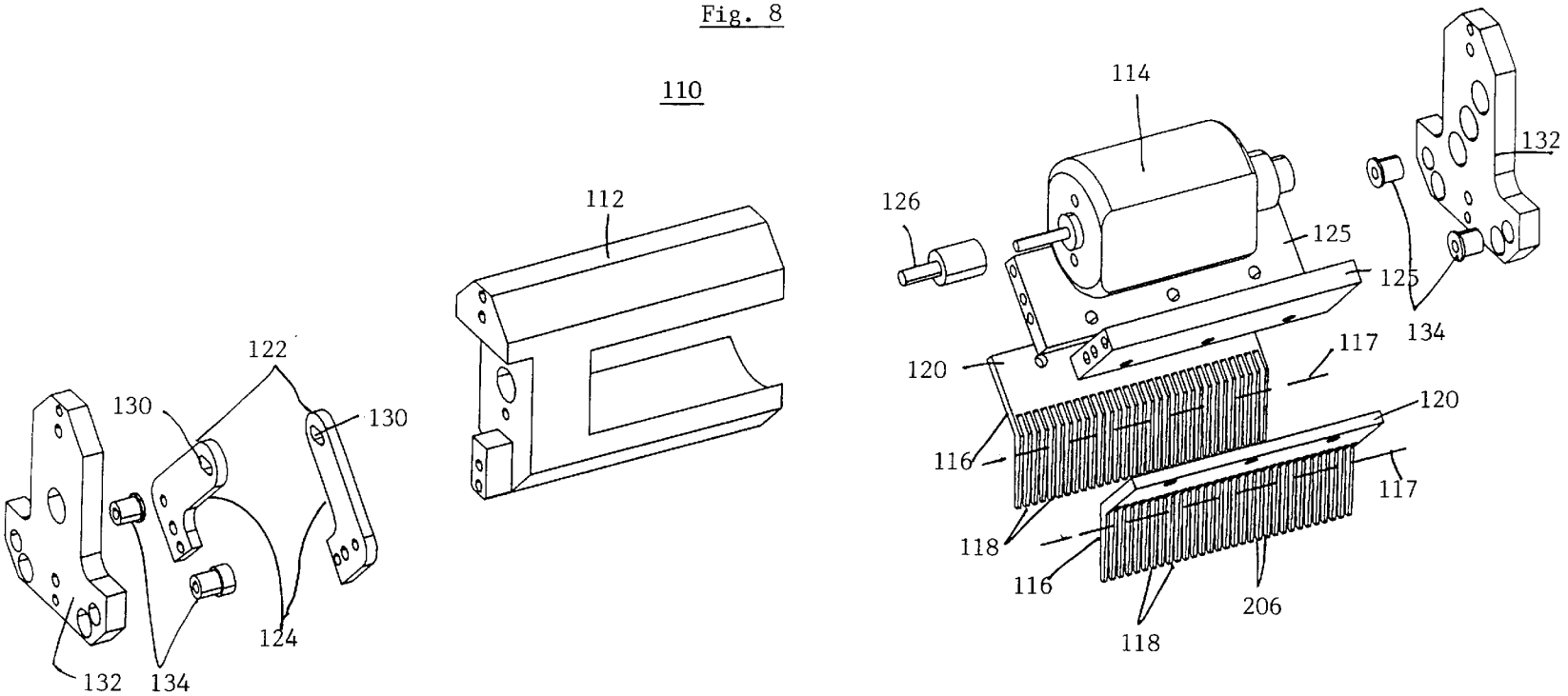
FIG. 8 is a perspective view of the apparatus shown in FIG. 7, when disassembled.

Additional nuts, pins, screws, etc., and their accepting holes, collectively indicated 134 in FIG. 8, can and are used to assemble apparatus 110 together, as well as end plates 132 for extra strength and stability.

The following describes several preferred embodiments which apply both to apparatus 10 and to apparatus 110.

Thus, according to one preferred embodiment of the present invention, housing 12 or 112 is formed with at least one battery accepting slot 202 for accepting at least one battery 204 which serves for providing motor 14 or 114 with power for operation.

According to another preferred embodiment of the present invention each of comb members 16 or 116 reciprocates (full motion) about 3,000 to about 12,000 times per minute, preferably, about 6,000 to about 8,500 times per minute. This is effected by appropriately selecting the revolution per minute of motor 14 or 114. Apparatus 10 or 110 can also be designed to have reciprocation speed control, using an appropriate potentiometer to control the operation of motor 14 or 114, such that different users can select the reciprocating speed with which they feel most comfortable.

According to yet another preferred embodiment of the present invention, when maximally crossed over, teeth 18 or 118 of two comb members 16 or 116, respectively, form an angle of about 0° to about 5° therebetween, preferably from about 0° to about 2°.

According to still another preferred embodiment of the present invention, when overlapped to the maximum, pointing ends of teeth 18 or 118 of twin comb members 30, are as distant from one another as from about 4 mm to about 2 mm.

According to still another preferred embodiment of the present invention each of teeth 18 or 118 narrows towards an end thereof farther from base portion 20 or 120 of its respective comb member 16 or 116. Different cross section can be selected for teeth 18 or 118, as further detailed in the Background section hereinabove.

According to yet another preferred embodiment of the present invention a gap 206 of about 0.05 mm to about 0.5 mm is present between adjacent teeth 18 or 118. Gap 206 is selected so as to enable the reciprocating motion herein described.

According to still another preferred embodiment each of teeth 18 or 118 extends about 8 mm to about 26 mm from base portion 20 or 120 of its respective comb member 16 or 116.

According to another aspect of the present invention there is provided a method of treatment of hair. The method can be used to detangle the hair, to inactivate or remove parasites such as lice therefrom and/or to remove particles such as dandruff from the hair.

The method according to the present invention is effected by implementing the following method steps, in which, in a first step, two comb members are provides, each having a longitudinal axis and is formed with teeth.

In a subsequent step of the method according to the present invention, the two comb members are contacted in a combing motion with the hair to be treated.

Then, in a final step according to the present invention, while combing the hair, each of the two comb members is reciprocated substantially perpendicularly to its longitudinal axis, so as to cause the teeth of each of the two comb members to reciprocally cross back and forth over and between the teeth of the other comb member.

According to a preferred embodiment of the method according to the resent invention, reciprocating each of two comb members is effected by a mechanism including two arms each engaging one of two comb members, each of arms is reciprocated by an eccentric shaft rotated by a motor.

According to another preferred embodiment of the method according to the present invention, reciprocating each of two comb members is effected by a mechanism including two arms each engaging one of two comb members, each of arms is reciprocated by an elliptic shaft rotated by a motor, which serves for departing two comb members, and further by a returning spring element which serves for attracting two comb members.

The apparatus and method according to the present invention differ from the prior art by providing comb members which reciprocate substantially perpendicularly to their longitudinal axes, so as to cause the teeth thereof to reciprocally cross back and forth over and between.

s such, the method and apparatus according to the present invention enjoy several advantages over the prior art. First, reciprocated as described, the method and apparatus according to the present invention are more effective in detangling hair. Second, reciprocated as described, the method and apparatus according to the present invention are more effective in inactivating or removing parasites, such as lice, from the hair. Third, reciprocated as described, the method and apparatus according to the present invention are more effective in removing particles, such as dandruff, from the hair.

Three additional advantages are worth mentioning. First, it will be appreciated by one ordinarily skilled in the art that by having the teeth of adjacent comb members crossing in-between one another, extra support is inflicted on each of the teeth, to thereby enable remarked reduction in teeth diameter. Second, due to the specialized and unique movement of the teeth, denser teeth structures can be exercised to thereby increase the effectively of the apparatus and method. Third, reciprocating in the manner described, i.e., perpendicularly to their longitudinal axes, the comb members produce vibration movements similar in magnitude, time and location, but opposite in sign, which thereby sum to reduce the vibration of the apparatus upon operation to minimum. It will be appreciated in this respect that the vibration minimization effect thus described for the apparatus according to the present invention is totally absent in apparatuses including a single comb member, and further that this effect is much less pronounced in apparatuses employing two comb members, reciprocating parallely along their longitudinal axes, because such parallely reciprocating comb members are more distant from one another at all times, as compared to the comb members according to the present invention.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. An apparatus for treatment of hair comprising:

(a) a housing engaging a motor;

(b) two comb members each having a longitudinal axis and being formed with teeth, each of said two comb members is movably engaged by said housing; and (c) a mechanism being engaged by said housing and operatively connecting between each of said two comb members and said motor, so as to force each of said two comb members to reciprocate substantially perpendicularly to its longitudinal axis, so as to cause the teeth of each of said two comb members to reciprocally cross back and forth over and between the teeth of the other comb member.

2. The apparatus of claim 1, wherein said mechanism includes two arms each engaging one of said two comb members, each of said arms is reciprocated by an eccentric shaft rotated by said motor.

3. The apparatus of claim 1, wherein said mechanism includes two arms each engaging one of said two comb members, each of said arms is reciprocated by an elliptic shaft rotated by said motor and which serves for departing said two comb members and further by a returning spring element which serves for attracting said two comb members.

4. The apparatus of claim 1, wherein said housing is formed with at least one battery accepting slot for accepting at least one battery, said at least one battery serves for providing said motor with power for operation.

5. The apparatus of claim 1, wherein each of said comb members reciprocates about 3,000 to about 12,000 times per minute.

6. The apparatus of claim 1, wherein when maximally crossed over, said teeth of said two comb members form an angle of about 0° to about 5° therebetween.

7. The apparatus of claim 1, wherein each of said teeth narrows towards an end thereof farther from a base portion of its respective comb member.

8. The apparatus of claim 1, wherein a gap of about 0.05 mm to about 0.5 mm is present between adjacent teeth.

9. The apparatus of claim 1, wherein each of said teeth extends about 8 mm to about 26 mm from a base portion of its respective comb member.

10. A method of treatment of hair comprising the steps of:

(a) providing two comb members each having a longitudinal axis and being formed with teeth;

(b) contacting in a combing action said two comb members with the hair to be treated; and (c) while combing the hair, reciprocating each of said two comb members substantially perpendicularly to its longitudinal axis, so as to cause the teeth of each of said two comb members to reciprocally cross back and forth over and between the teeth of the other comb member.

11. The method of claim 10, wherein reciprocating each of said two comb members is effected by a mechanism including two arms each engaging one of said two comb members, each of said arms is reciprocated by an eccentric shaft rotated by a motor.

12. The method of claim 10, wherein reciprocating each of said two comb members is effected by a mechanism including two arms each engaging one of said two comb members, each of said arms is reciprocated by an elliptic shaft rotated by a motor, which serves for departing said two comb members, and further by a returning spring element which serves for attracting said two comb members.

13. The method of claim 10, wherein each of said comb members reciprocates about 3,000 to about 12,000 times per minute.

14. The method of claim 10, wherein when maximally crossed over, said teeth of said two comb members form an angle of about 0° to about 5° therebetween.

15. The method of claim 10, wherein each of said teeth narrows towards an end thereof farther from a base portion its respective comb member.

16. The method of claim 10, wherein a gap of about 0.05 mm to about 0.5 mm is present between adjacent teeth.

17. The method of claim 10, wherein each of said teeth extends about 8 mm to about 26 mm from a base portion of its respective comb member.

* * * * *